US008978434B2

(12) United States Patent
Huon

(10) Patent No.: US 8,978,434 B2
(45) Date of Patent: Mar. 17, 2015

(54) METHOD AND EQUIPMENT FOR MAKING A SPRING

(75) Inventor: Serge Huon, Maisons Laffitte (FR)

(73) Assignee: Ressorts Huon Dubois, Conflans Sainte Honorine (FR)

( * ) Notice: Subject to any disclaimer, the term of this patent is extended or adjusted under 35 U.S.C. 154(b) by 789 days.

(21) Appl. No.: 13/127,899

(22) PCT Filed: Oct. 26, 2009

(86) PCT No.: PCT/FR2009/052054

§ 371 (c)(1),
(2), (4) Date: May 5, 2011

(87) PCT Pub. No.: WO2010/052407

PCT Pub. Date: May 14, 2010

(65) Prior Publication Data

US 2011/0209514 A1 Sep. 1, 2011

(30) Foreign Application Priority Data

Nov. 5, 2008 (FR) ..... 08 06192

(51) Int. Cl.

| | |
|---|---|
| ***B21F 3/04*** | (2006.01) |
| ***B21F 3/10*** | (2006.01) |
| ***B21F 11/00*** | (2006.01) |
| ***B21F 3/06*** | (2006.01) |
| ***B21F 3/02*** | (2006.01) |

(52) U.S. Cl.
CPC .... *B21F 3/06* (2013.01); *B21F 3/02* (2013.01)
USPC ..... 72/145; 72/138; 72/132

(58) Field of Classification Search
USPC ..... 72/145, 138, 132, 139, 140, 143, 144, 72/135, 137
See application file for complete search history.

(56) References Cited

U.S. PATENT DOCUMENTS

| | | | | |
|---|---|---|---|---|
| 1,981,566 | A | 11/1934 | Nigro | |
| 2,091,136 | A * | 8/1937 | Blount | 72/145 |
| 2,655,973 | A * | 10/1953 | Hoelsch | 72/135 |
| 4,393,678 | A | 7/1983 | Favot et al. | |
| 4,986,103 | A * | 1/1991 | Jacobson | 72/137 |
| 5,259,226 | A * | 11/1993 | Itaya | 72/138 |
| 6,584,823 | B2 * | 7/2003 | Hresc et al. | 72/129 |
| 6,648,996 | B2 * | 11/2003 | Hasegawa | 72/138 |
| 8,136,379 | B2 * | 3/2012 | Itaya | 72/135 |

FOREIGN PATENT DOCUMENTS

FR 1 048 390 A 12/1953

OTHER PUBLICATIONS

International Search Report, dated Mar. 10, 2010, from corresponding PCT application.

* cited by examiner

*Primary Examiner* — Shelley Self
*Assistant Examiner* — Mohammad I Yusuf
(74) *Attorney, Agent, or Firm* — Young & Thompson

(57) ABSTRACT

A method for making a variable pitch spring (9), in which a spring wire (1) is bent using bending lugs (5, 6) so as to impart a spiral configuration thereto, a gap is formed between the turns by placing, between the turns being formed, the beveled side of a rotary disc (2) having a rotation synchronized with the spring wire supply, the disc (2) having a beveled profile that varies along the periphery of the disc, and the spring wire is cut (3) at the end of the formation of each spring.

20 Claims, 3 Drawing Sheets

Fig. 2
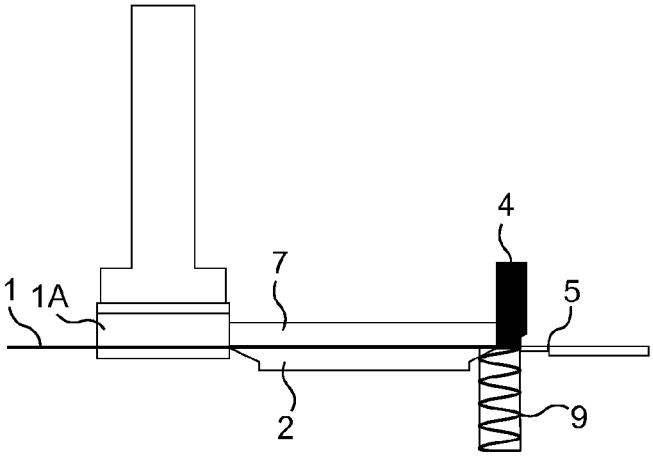
Fig. 1
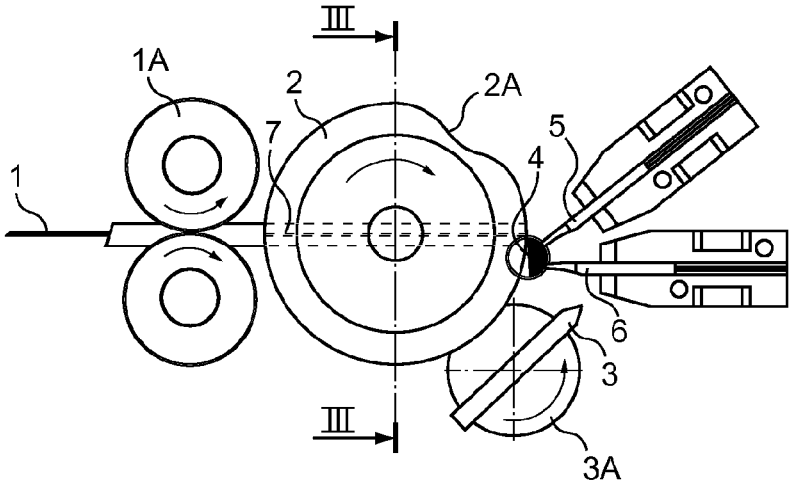
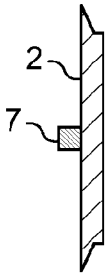
Fig. 3
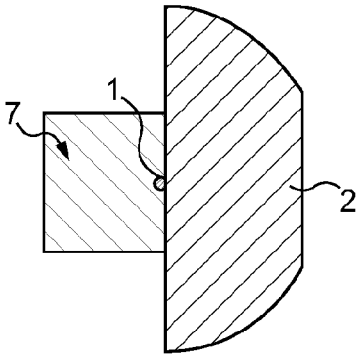
Fig. 4
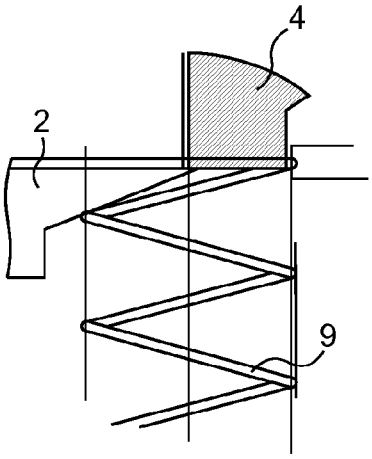
Fig. 5

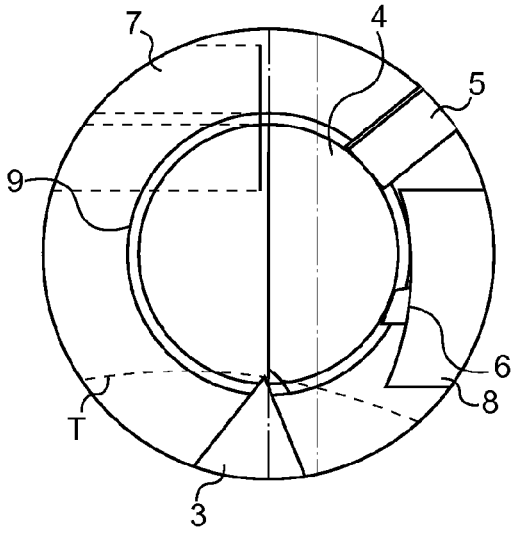
Fig. 10
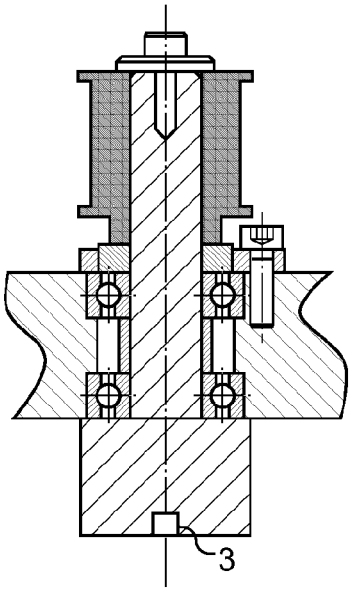
Fig. 11
Fig. 12
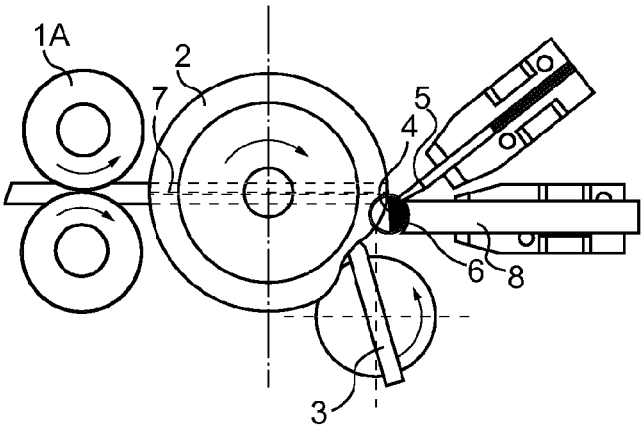
Fig. 13
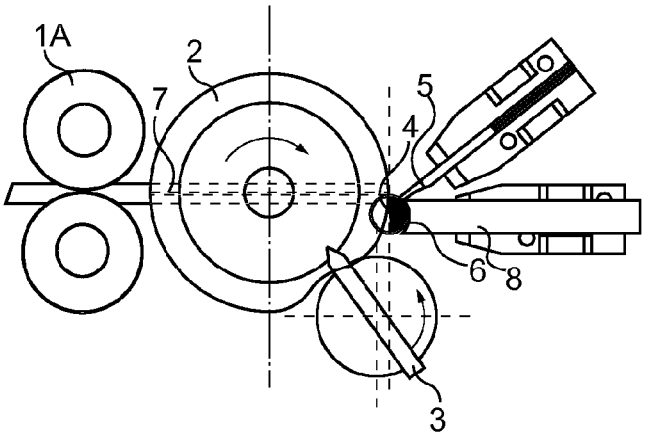

METHOD AND EQUIPMENT FOR MAKING A SPRING

BACKGROUND OF THE INVENTION

1. Field of the Invention

The invention concerns the manufacture of coil springs, in particular compression coil springs.

2. Description of the Related Art

As is known in the art, coil springs are generally manufactured from a substantially straight wire traveling along a linear path (in practice between drive rollers) to bending fingers that impose on it a curvature corresponding to the diameter of the spring to be produced. Turns are formed in this way that are contiguous unless a beveled tool is inserted to bring about a separation between the turns being formed (when such a tool defines the pitch of the spring, it is sometimes called a "pitch tool"). After the spring formed in this way has reached the required length, the wire is cut; the spring formed in this way is recovered and a new manufacturing cycle is started.

It should be pointed out that, in the conventional way, the insertion of a beveled tool to bring about a non-zero spacing between the adjacent turns is effected in accordance with an alternating to-and-fro movement transversely to the path of the wire. Such an alternating movement is in particular the result of the fact that, in practice, springs with non-contiguous turns, especially compression springs, nevertheless have near their ends end turns that are contiguous to provide a substantially transverse bearing area; thus during the manufacture of such a spring there are times at which the pitch tool must be between the turns and times at which it must be retracted.

As for cutting the wire at the end of the formation of each spring, it is generally brought about by a cutting tool driven with an alternating to-and-fro movement; there has also been proposed a movement of the cutting tool comprising a movement transverse to the wire and a movement tangential thereto, so that the tool moves in a closed loop, substantially retaining a given orientation.

Thus existing machines use both circular movements and translation (linear) movements, and the cycle of forming a spring in practice imposes stopping or at least considerably slowing the wire feed speed at the moment of cutting.

Where linear movements are concerned, these are circular movements converted into linear movements by a complex system of cams, links or direction-changers, to ensure coordinated movements of the pitch and cutting tools, which leads to wear and vibration.

Such vibration and systematically stopping at the time of cutting operations limit considerably the speed of the machine, reduce production quality and lead to high maintenance costs with long down times, whence low productivity.

BRIEF SUMMARY OF THE INVENTION

An object of the invention is to enable the pitch of a coil spring to be controlled by a tool such that the change of configuration of the tool relative to the spring being formed is effected without stopping feeding of the spring wire and without significant vibration.

Another object of the invention is to enable cutting of a spring wire at the end of each cycle of forming a spring without having to stop the feeding of the spring wire and without generating vibration.

Clearly the aforementioned two aspects may be considered independent, although it is advantageous for them to operate synergistically.

To this end the invention proposes a method for making a variable pitch spring, in which a spring wire is bent using bending fingers so as to impart a spiral configuration thereto, a gap is formed between the turns by placing between the turns being formed the beveled edge of a pitch tool including a rotary disk having a rotation synchronized with feeding the spring wire, the disk having a beveled profile that varies along the periphery of the disk and the spring wire being cut at the end of forming each spring.

This edge is preferably disposed between only some of the turns of a spring so that the spring includes contiguous turns and turns having a non-zero varying pitch.

The disk is preferably driven with a rotation speed such that the formation of a spring corresponds to one rotation of the disk.

The spring wire is advantageously cut by means of a cutting tool driven in rotation in synchronism with the separator disk. The rotation of the cutting tool preferably has the same speed as the separator disk.

The separator disk advantageously has a rotation speed that is constant.

It should be noted that the fact that the rotation of the separator disk is synchronized with the feeding of the spring wire does not imply in itself that either this rotation or that of the cutting tool is constant; the rotation speed of the cutting tool and that of the separator disks may vary, and they may even stop and restart independently, provided that the synchronization of the speeds with each other and with the feeding of the spring wire enable the cut to be made at the proper place.

The invention also proposes, for implementing the invention, an installation for manufacturing a spring, including spring wire feed members, bending fingers for deforming this wire into a spiral having a predetermined diameter, a separator adapted to be disposed between turns being formed to generate a separation between them, and a cutting tool, characterized in that the separator is a rotary disk the rotation whereof is synchronized with the spring wire feed speed and the edge of which has a beveled profile that varies along the periphery of the disk, which is disposed so as to cause this peripheral edge to travel between turns in the process of being formed by this edge.

The disk advantageously has a peripheral portion of constant diameter and a complementary portion in the form of a flat, this complementary portion being adapted to remain away from turns in the process of formation.

The slope of the bevel on the edge of the disk advantageously increases along the periphery of the disk from one edge of the flat portion to a maximum and then decreases to another edge of the flat portion.

The cutting tool is advantageously mounted to rotate synchronously with the separator disk so as to cut the spring wire transversely to its length. The cutting tool is preferably carried by a disk parallel to the separator disk. The cutting tool is preferably mounted so as to run alongside the separator disk between cutting operations.

The installation advantageously includes a finger bearing against turns between which the edge of the separator disk is disposed.

It will be appreciated that the invention therefore leads to elimination of the stopping of the feeding of spring wire made necessary by the alternating linear movements of the prior art solutions.

BRIEF DESCRIPTION OF THE DRAWINGS

Objects, features and advantages of the invention emerge from the following description given by way of nonlimiting illustration with reference to the appended drawings in which:

FIG. 1 is a partial view in elevation of the core of an installation of the invention for manufacturing compression springs, FIG. 2 is a view of it from above, FIG. 3 is a view of it in cross section taken along the line III-III in FIG. 1, FIG. 4 is an enlarged view of the detail IV in FIG. 3, FIG. 5 is an enlarged view of the detail V in FIG. 2, FIG. 10 is a detail view of the spring in the process of being cut, FIG. 11 is a view in section of the disk carrying the cutting tool, FIG. 12 is a view of the FIG. 6 installation shortly after the cutting operation, and FIG. 13 is a view of the FIG. 6 installation with the cutting tool alongside the rotary separator disk.

DETAILED DESCRIPTION OF THE PREFERRED EMBODIMENTS

Figure 7:
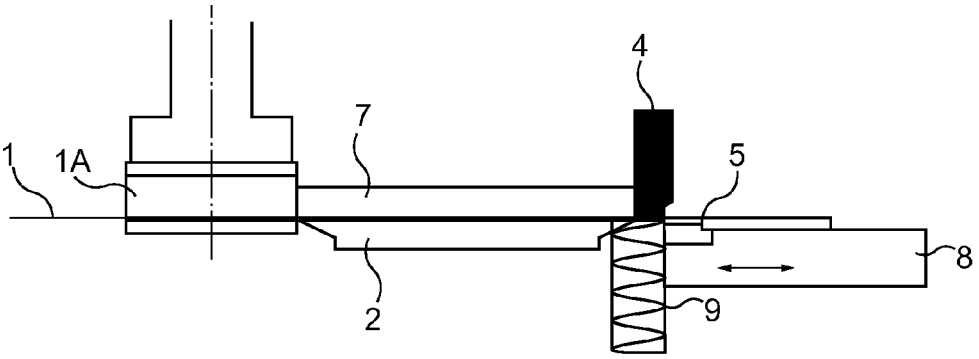
FIG. 7 is a view of it from above.

FIGS. 1 and 2 represent diagrammatically the core of an installation for manufacturing compression springs.

These springs are formed from spring wire and include contiguous turns at the ends and turns having a non-zero separation between the ends.

Spring wire is conventionally available on spools; a spool of this kind is unwound, by members known in the art and not shown, and the spring wire 1 is fed along a rectilinear path which here is horizontal by drive rollers 1A. The wire is then guided by a rod 7 and a part 2 as far as the proximity of bending fingers 5 and 6, of where there are two here, adapted to impart a constant curvature to the spring wire as it is fed; this wire thus forms a continuous spiral, the turns of which are normally contiguous.

This shaping of the wire by the bending fingers is facilitated by the presence of a former 4 the section of which is advantageously half-moon-shaped.

In the example shown, the spring wire is conformed downward.

A rotary separator disk, here coinciding with the guide part 2, has a beveled edge alongside the bar 7 and the edge of the former 4.

Over a part of its periphery this rotary separator disk 2 has a reduced radius forming a flat 2A.

This disk is positioned relative to the bending fingers 5 and 6 and the former so that its beveled periphery can run alongside a turn being formed so as to cause it to be inclined away from the former, thus bringing about the appearance of a gap between the successive turns.

The slope of this bevel advantageously varies along the periphery, from a minimum value near one edge of the flat 2A, then at a constant value defining the intended spacing of the turns, and then reducing to another minimum value near the other edge of the flat 2A. This slope variation thus varies the pitch of the spring while it is being formed.

In practice, the separator disk 2 is synchronized with the rotation of the rollers 1A so that one rotation of the disk corresponds to the formation of one spring 9; the beginning of such a spring corresponds to the passage of the flat in front of the bending fingers, which corresponds to an absence of separation of the turns; an edge of the flat passing in front of the edge of the former then brings about progressive separation of the turns, up to a maximum separation corresponding to the maximum slope of the periphery of the disk; when the other edge of the flat approaches the edge of the former 4 and the slope of the disk decreases locally, the separation between turns decreases until it reaches zero at the moment at which the flat comes to face the edge of the former. By cutting the wire a spring is thus obtained that is detached and may be recovered by any appropriate means known in the art.

Cleary the synchronization between the various movements does not imply that the speeds are constant; the speed of the cutting tool and that of the rotary disk may vary, and they may even be stopped and restarted independently; at the moment of cutting, however, the cutting tool 3 and a flat 2A of the rotary disk 2 face each other to enable this cutting.

Clearly, since the separator tool determining the varying pitch (varying between zero and a maximum value) of the spring is a rotary element, there is much less vibration than with a separator with linear alternating movement and manufacture may be effected at a significantly higher speed than with an alternating linear movement separator of that kind.

In the example shown, the rotary separator disk has the same rotation direction as that in which the bending fingers bend the spring wire as and when it arrives, but it is readily apparent that rotation in the opposite direction is equally possible.

It may be noted that the figures correspond to springs wound to the left; it is within the general background knowledge of the person skilled in the art to adapt the above teachings to the production of right-hand springs (by having the spring wound upward with the finger 5 at the bottom and the cutter at the top; this corresponds to simply inverting the figures).

The direction of rotation of the rotary disk may be clockwise or anti-clockwise.

The spring wire is advantageously cut at the end of forming a spring by a rotary tool formed here by a cutter disposed on a diameter of a rotary disk 3A. Its operation is described in detail hereinafter. The fact that the cutting tool is fastened to a disk has the particular advantage that this disk constitutes a flywheel contributing to the effectiveness of cutting.

Figure 6:
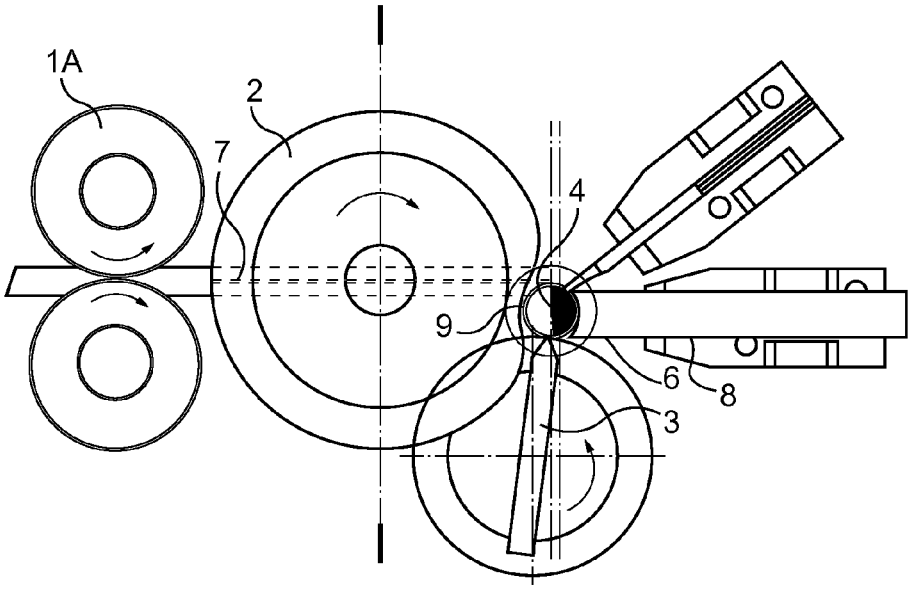
FIG. 6 is a partial view in elevation of the core of a variant installation for manufacturing compression springs.
Figure 8:
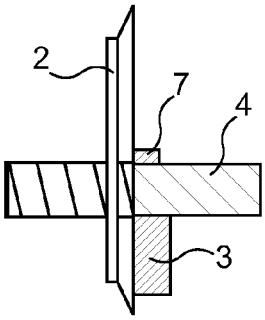
FIG. 8 is a view in cross section taken along the line VIII-VIII in FIG. 6.

FIGS. 6 and 7 represent an installation similar to that from FIGS. 1 and 2 except that a third finger 8 has been added. This finger 8 exerts pressure on the body of the spring while it is being formed, which contributes to regulating the diameter of the turns that are spaced. The forming of the non-zero pitch of the middle turns of the spring may induce a defect whereby the diameter of these turns is reduced; the presence of this third finger makes it possible to reduce this effect (see FIG. 10).

The rotation of the cutting tool 3 is synchronized with the rotation of the separator disk 2 to ensure that the spring wire is cut facing each flat of the separator disk; because the separator disk has only one flat, it follows that the two disks turn at the same speed (the formation of a spring corresponds to one turn of the separator device and one turn of the cutting tool).

Figure 9:
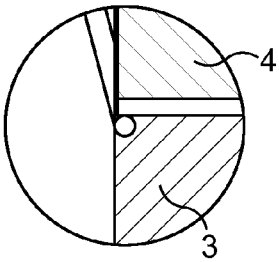
FIG. 9 is a detail view showing the spring wire in the process of being cut by the cutting tool.

Cutting as such by the cutting tool occurs at the end of the former 4 (see FIGS. 9 and 10).

In FIGS. 6 and 7 the cutting tool is in the process of cutting the wire at the end of forming a spring; it may be noted that the cut is therefore made transversely to the length of the tool and not in the direction thereof; the end of the cutting tool may of course be curved to facilitate this cutting effect.

The cutting tool is dimensioned and located so that it may run alongside the separator disk without impeding it. Note that that the point of the cutting tool is masked by the separator disk although this disk has its flat facing this tool (see FIG. 12); as for FIG. 13, it represents a configuration in which the tip of the cutting tool lies practically on a radius of the separator disk, passing under the rod 7.

Because the rollers, the separator disk and the cutting tool all rotate continuously, the general structure of the installation is simplified because it is no longer necessary to provide movement conversion or linkages: this contributes to making the installation more robust, at the same time as allowing constant operating speeds and therefore improved performance.

Compared to the prior art, it will be realized that eliminating stopping linked to movement of the separator and/or the cutting tool and alternating linear movements to result in a continuous (and in practice constant) circular kinetic also contributes to eliminating much vibration and wear. This makes possible a reduction of as much as 90% of the down time and maintenance costs as well as an increase in the rate of production (which may be multiplied by a factor of the order of 4 to 6 compared to prior art machines).

A large proportion of the aforementioned advantages is preserved if, as indicated above, the rotation of the rotary disk and the cutting tool can vary (stop and restart), since there is no reversing of the direction of movement as in prior art solutions.

The fact that the separator disk is also a guide member for the spring wire is also a simplification in itself.

Clearly it will be evident to the person skilled in the art how to define the changing profile of the periphery of the separator disk as a function of the required evolution of the pitch of the springs concerned.

It is furthermore clear that it will be evident to the person skilled in the art how to optimize the profile of the flat as a function of the required evolution of the pitch of the spring concerned.

It has been pointed out that the invention applies in particular to the manufacture of compression springs, as they include both contiguous turns and turns having a non-zero longitudinal separation; however, the invention is easy to generalize to other springs having this kind of variation of pitch between turns, for example torsion springs.

It is worth noting that the separator disk may include a plurality of flats so that a plurality of springs may be formed during one rotation of the disk, while the cutting tool has a rotation speed proportional to this number of flats or a number of cutting portions equal to this number of flats. Nevertheless, providing a single flat on the separator disk has the advantage of guaranteeing that all the springs are exactly identical to each other.

More generally, the invention may be generalized to the situation of varying pitch springs even if the pitch is never reduced to zero (in which case it is not necessary to provide flats that remain away from springs being formed).

The invention claimed is:

1. A method for making a variable pitch spring, comprising the steps of:

feeding spring wire feed forward at a spring wire feed speed to a rotary separator disk and to bending fingers, wherein the rotary separator disk has a bevelled edge with a varying profile along a length of the periphery of the rotary separator disk;

synchronizing rotation of the rotary separator disk with movement of the wire at the spring wire feed speed;

bending the spring wire using the bending fingers so as to impart a spiral configuration to the spring wire;

placing the bevelled edge of the rotary separator disk between turns of the spring wire during formation of the turns to form a gap between the turns, wherein as a consequence of i) the varying profile of the bevelled edge, and ii) an instant angular position of the rotary separator disk, the bevelled edge defines a varying gap between the turns of the spring; and cutting the spring wire at an end of forming the spring.

2. The method according to claim 1, wherein, during forming the spring, the bevelled edge is disposed between only some of the turns of the spring so that the spring includes contiguous turns and turns having a non-zero varying pitch.

3. The method according to claim 1, wherein the rotary separator disk is driven with a rotation speed such that the formation of the spring corresponds to one rotation of the rotary separator disk.

4. The method according to claim 1, wherein the spring wire is cut by a cutting tool driven in rotation in synchronism with the rotary separator disk.

5. The method according to claim 4, wherein the rotation of the cutting tool has the same speed as the rotary separator disk.

6. The method according to claim 1, wherein the rotary separator disk has a rotation speed that is constant.

7. An installation for manufacturing a spring, said installation comprising:

spring wire feed members that feed the spring wire at a spring wire feed speed, bending fingers that deform the wire supplied from the spring wire feed members into a spiral having a predetermined diameter, a rotary separator disk located between the spring wire feed members and the bending fingers, and a cutting tool that cuts the spring wire, wherein the rotary separator disk has a rotation synchronized with the spring wire feed speed, the rotary separator disk having a periphery edge located between turns of the spring during formation of the turns, the peripheral edge having a beveled profile that varies along a periphery of the rotary separator disk, wherein the varying bevelled profile of the peripheral edge and an instant angular position of the rotary separator disk forms a varying gap between the turns of the spring during formation of the turns.

8. The installation according to claim 7, wherein the rotary separator disk has a first peripheral portion of constant diameter and a complementary second peripheral flat portion, the complementary second peripheral flat portion being adapted to remain away from the turns during formation of the turns.

9. The installation according to claim 7, wherein a slope of the bevel on the edge of the rotary separator disk increases along the periphery of the rotary separator disk from one edge of the complementary second peripheral flat portion to a maximum and then decreases to another edge of the complementary second peripheral flat portion.

10. The installation according to claim 7, wherein the cutting tool is mounted to rotate synchronously with the rotary separator disk so as to cut the spring wire transversely to a length of the spring wire.

11. The installation according to claim 10, wherein the cutting tool is carried by a disk parallel to the rotary separator disk.

12. The installation according to claim 10, wherein the cutting tool is mounted so as to run alongside the rotary separator disk between cutting operations.

13. The installation according to claim 7, further comprising a finger bearing against turns between which the peripheral edge of the rotary separator disk is disposed.

14. The installation according to claim 8, wherein the slope of the bevel on the peripheral edge of the rotary separator disk increases along the periphery of the rotary separator disk from one edge of the flat portion to a maximum and then decreases to another edge of the flat portion.

15. The installation according to claim 8, wherein the cutting tool is mounted to rotate synchronously with the rotary separator disk so as to cut the spring wire transversely to length of the spring wire.

16. The installation according to claim 9, wherein the cutting tool is mounted to rotate synchronously with the rotary separator disk so as to cut the spring wire transversely to length of the spring wire.

17. The installation according to claim 11, wherein the cutting tool is mounted so as to run alongside the rotary separator disk between cutting operations.

18. The method according to claim 2, wherein the rotary separator disk is driven with a rotation speed such that the formation of a spring corresponds to one rotation of the rotary separator disk.

19. The method according to claim 2, wherein the spring wire is cut by means of a cutting tool driven in rotation in synchronism with the rotary separator disk.

20. An installation for manufacturing a variable pitch spring, said installation comprising:

drive rollers (1A) that fed spring wire forward at a spring wire feed speed;

bending fingers (5, 6) that deform the spring wire into a spiral having a diameter;

a former (4) being located adjacent ends of the bending fingers, wherein the bending fingers and the former impart a curvature to the spring wire as the wire is fed by the drive rollers such that the spring wire thus forms a continuous spiral;

a rod (7) located adjacent the former;

a guide part located below the rod and comprised of a rotary separator disk (2) having a rotation synchronized with the spring wire feed speed feeding the spring wire, the rotary separator disk having i) a first peripheral portion with a bevelled edge alongside the rod and an edge of the former, and ii) a second peripheral portion with a flat (2A) located over a part of a periphery of the rotary separator disk with a reduced radius, the bevelled edge having a slope that varies along the periphery from a first minimum value near a first edge of the flat, then at a value defining spacing of the turns, and then reducing to a second minimum value near a second edge of the flat, wherein the rod and the guide part feed the spring wire forward from the drive rollers to the former and the bending fingers with the rotary separator disk being disposed between the turns of the spiral thereby generating a separation between the turns of the spiral with the rotary separator disk being positioned relative to the bending fingers and the former so that the bevelled edge runs alongside a current turn being formed to cause the current turn to be inclined away from the former and thus bringing about a gap between successive turns, the slope of the bevelled edge varying along the periphery slope varying a pitch of the spring while the spring is being formed; and a cutting tool (3) mounted to cut the spring wire transversely to a length of the spring wire.

* * * * *